US008186995B2

(12) United States Patent
Putrello, Jr.

(10) Patent No.: US 8,186,995 B2
(45) Date of Patent: May 29, 2012

(54) SURVIVAL TOOL FIRE STARTER WITH MISCHMETAL FLINT ROD

(76) Inventor: Andrew C. Putrello, Jr., Utica, NY (US)

( * ) Notice: Subject to any disclaimer, the term of this patent is extended or adjusted under 35 U.S.C. 154(b) by 765 days.

(21) Appl. No.: 12/392,535

(22) Filed: Feb. 25, 2009

(65) Prior Publication Data

US 2009/0214996 A1 Aug. 27, 2009

Related U.S. Application Data

(63) Continuation-in-part of application No. 12/070,741, filed on Feb. 22, 2008.

(51) Int. Cl.
*F23Q 1/02* (2006.01)

(52) U.S. Cl. ..... 431/273; 431/124; 431/133; 431/127; 431/267; 431/269; 44/507; 44/506; 44/508; 148/557; 148/401; 148/404; 149/38; 149/41; 149/42

(58) Field of Classification Search ..... 431/273, 431/124, 133, 127, 269, 267; 148/557, 401, 148/404; 44/507, 506, 508; 280/87.042; 126/25 B; 149/38, 41, 42; 7/158
See application file for complete search history.

(56) References Cited

U.S. PATENT DOCUMENTS

| | | | | |
|---|---|---|---|---|
| 2,908,071 | A * | 10/1959 | Bungardt | 428/585 |
| 3,275,484 | A * | 9/1966 | Foote et al. | 149/38 |
| 3,278,009 | A * | 10/1966 | Crump, Jr. | 206/121 |
| 4,089,706 | A | 5/1978 | Zeiringer | |
| 4,698,068 | A * | 10/1987 | Jensen | 44/507 |
| 6,782,576 | B1 | 8/2004 | Valencic et al. | |
| 2005/0127630 | A1 * | 6/2005 | Kuhlman et al. | 280/87.042 |

* cited by examiner

*Primary Examiner* — Steven B McAllister
*Assistant Examiner* — Avinash Savani
(74) *Attorney, Agent, or Firm* — Hiscock & Barclay, LLP

(57) ABSTRACT

A fire-starter device for survival or emergency use has a handle portion and case portion that twist together, to sheath a mischmetal flint rod inside the case, and a seal ring protects the flint rod from environmental moisture. The case has a steel strike plate and a guide channel. The mischmetal flint rod favorably has a composition of cerium—50%, lanthanum—26%, magnesium—10%, praseodymium—3%, neodymium—1%, and iron—10%.

5 Claims, 2 Drawing Sheets

SURVIVAL TOOL FIRE STARTER WITH MISCHMETAL FLINT ROD

CROSS REFERENCE TO RELATED APPLICATION

This is a continuation-in-part of my pending application Ser. No. 12/070,741, filed Feb. 22, 2008. The disclosure thereof is incorporated herein by reference.

BACKGROUND OF THE INVENTION

This invention relates to outdoor, camping, sporting and military equipment, and is in particular directed to military and/or civilian survival devices. More specifically, the invention is directed to a spark-generating device in which a steel strike plate contacts a flint rod member to generate sparks which can be used to ignite flammable material for starting a fire.

Emergency fire starters are typically included as equipment for many civilian and military occupations, as well as for recreational outdoor use. In its simplest form, a steel strike plate member is struck against a flint member, e.g., a flint rod, to produce sparks. The sparks can be used to ignite a finely divided flammable material, which can then be used to light a fire on available flammable materials, e.g., fire wood.

Currently many fire starters employ a flint-and-steel strike principle to start a flame. One common survival tool uses a flint-steel rod mounted within a block of magnesium. The principle of operation behind such a device is to allow the user first to scratch off small flakes of magnesium metal onto fire-starting tinder, and then ignite the magnesium with sparks from the flint-steel. In practice, it is very difficult to hit the tiny scratched-off flakes of magnesium with the shower of sparks obtained by scratching the flint-steel rod. Moreover, in the windy conditions that are often found in a survival setting, this task becomes virtually impossible. In state-of-art fire-starting devices there is insufficient magnesium (if any) in the flint rod to generate sparks hot enough to actually light the tinder material on their own. Hence, in this prior art fire-starter, it is necessary for the user to carry a block of magnesium—to obtain the magnesium flakes or pieces that can be used to ignite the tinder. In an ideal fire starter, the flint rod should provide ignited particles that are able to ignite the tinder without having to provide additional particles of magnesium or other spark-ignitable material. However, nothing suitable has yet been proposed in this field.

In addition, the flints used in the current mode of fire starters are highly susceptible to corrosion and/or deterioration from environmental factors, which limits their utility as a survival tool. Fire-starting rods are typically composed of a mixture of rare earth elements (e.g., cerium, lanthanum, praseodymium, and other elements from that family) in combination with iron and/or iron oxide. The elements normally used in the many different compositions of fire-starting flint rods have high standard reduction potentials and have a great tendency to give up their valence electrons. Also, several of these elements—cerium and lanthanum, for example—not only oxidize very easily but decompose in water (and corrode rapidly in warm water). Under conditions where an electrolyte or reagent is present (such as a salt water environment) a flint rod will completely disintegrate within 24 hours. There have been many occasions in which persons needing to use their fire starters have gone to retrieve it, but found only dust in their back packs where their fire starters had been stored. Also, the rods of many types of fire starters (such as the type that has a flint-steel rod mounted on a magnesium block) will react violently when immersed in salt water producing heat and hydrogen gas. This is hardly a desirable attribute, considering that a wet or marine environment is the very type of environment where a survival tool of this type may be needed, especially for emergency responders and military personnel. A fire starter using any type of flint-steel that is not completely sealed from the elements (especially water) is not a practical survival tool in the real world. While it would seem that the problem could be solved simply by making the tool in a fashion to seal up the vulnerable flint rod to protect it from moisture, this simple solution has to date, in fact, completely escaped the survival tool industry.

With regard to the electric version of the fire starter, such as the fire starter described in application Ser. No. 12/070,741, the composition of the anode and cathode portions of the device must have different standard reduction potentials. The elements normally used in fire starting flint rods are excellent electron donors due to their very high standard reduction potential values, with their natural tendency to lose electrons. In the future, the power needed to run small electrical devices will become lower and lower and make devices such as this more and more practical. The electric version of the fire starter can easily produce voltages from 1.5 to 3 volts along with enough current to power low powered devices. The larger the difference between the standard reduction potentials of the parts that actually make up the device, the more voltage the device will produce. However, this construction also makes the device more susceptible to corrosion and damage from water and other electrolytes in the environment, which may come into contact with the flint rod.

The term "mischmetal" is understood in the art to be an alloy of rare earth elements, namely those of the lanthanum series with atomic numbers from 57 to 71, and these typically include cerium, lanthanum, and minor amounts of neodymium and praseodymium, as well as trace amounts of other elements in the series. Mischmetal has been used as a component of lighter flints, but in that case it has been blended with iron, iron oxide and magnesium oxide to form a harder material, known as "ferrocerium", as the cerium mischmetal would be too soft on its own to form sparks. The small amount of sparks available from the ferrocerium mischmetal flints makes them suitable for butane-based cigarette lighters, but not for survival tools for emergency use.

OBJECTS AND SUMMARY OF THE INVENTION

Accordingly, it is an object of the present invention to provide a survival tool fire starter that is simple in design and usage, compact, reliable, and overcomes the drawbacks of conventional fire starter tools, as described above.

It is another object to provide a fire starter that is relatively safe from environmental contamination when not in use.

A further object to provide a fire starter survival tool that is compact and simple, and which does not require special additional materials, yet can reliably ignite a fire under most outdoor conditions, and notably in a survival situation where the ability to start a fire is critical to survival.

In accordance with one aspect of the present invention, a flint-based fire-starter survival tool, is formed in two parts that screw together for storage, a handle portion and a base portion. The handle portion has handle base with a knurled gripping surface; a male threaded portion that extends out distally from the handle base; and a mischmetal flint rod that extends out distally from the male threaded portion. In this invention the flint rod is formed of a mischmetal material having a negative standard reduction potential and a composition, by weight, generally as follows:

Cerium—one half
Lanthanum—one quarter
Magnesium—at least ten percent
Other rare earth elements—up to five percent
Iron—balance (usually about the same amount as the magnesium).

The case portion detachably mates with said handle portion to sheath said flint rod and to seal it from the environment when it is not in use. The case portion is formed of a case base, which can be generally cylindrical, having an axial cavity adapted to accept the mischmetal flint rod and with a female threaded portion at a proximal end of the axial cavity to mate with the male threaded portion of the handle portion. A steel strike plate is affixed to a distal surface of said case base; and a guide channel is formed in the case base leading to said strike plate for guiding the flint rod to contact the strike plate.

A seal ring is disposed on one or the other of the handle portion and said case portion, and serves for forming a watertight seal between the two portions and sealing up the flint rod when the male threaded portion is screwed into the female threaded portion.

In a preferred embodiment, the mischmetal material is composed of the following, by weight:

cerium—50%; lanthanum—26%; magnesium—10%; praseodymium—3%; neodymium—1%; iron—10% (exclusive of any impurities which may be present).

The handle base and said case base are favorably formed of a cylindrical shape, with knurled cylindrical surfaces. The guide channel is a partly cylindrical cutout that extends diagonally into a distal end of said case base. The strike plate is seated in a recess in the distal end of the base portion, so it does not catch or tear cloth material of the user's pockets.

The mischmetal rod composition of this invention allows the user to obtain both a sufficient ignition spark and an ample shower of hot burning flakes of magnesium in one striking motion, for igniting the tinder. In other fire starting flint rods with significantly lower percentages of magnesium and higher percentages of iron, the device produces a poor spark and insufficient quantities of burning magnesium to ignite tinder effectively. Those flint rods are also very hard, difficult to scratch, and in a very short time dull the steel strike blades used to strike them. There has to be enough magnesium within the fire-starting rod to produce large burning sparks, while there is still enough of the other components to obtain a usable spark to ignite the magnesium simultaneously. The flint rod composition of Iron 10%, Magnesium 10%, Cerium 50%, Lanthanum 26%, Neodymium 1%, Praseodymium 3%, seems to be close to ideal. This improved composition results in a fire-starting flint rod that has both mechanical strength and excellent fire starting properties. The magnesium is softer than the iron it replaces, and peels off and simultaneously ignites (by interaction with the rare-earth metals cerium and lanthanum) when the fire-starting rod is scratched with the built-in strike plate, i.e., steel blade or knife. The increased amount of magnesium (relative to the percentage of iron) results more scratched magnesium pieces, and larger ones, which continue to burn and ignite the fire starting tinder. Much larger burning particles (sparks) are obtained as compared to rods containing other compositions. The slightly softer composition of the fire starting rod also extends the useful life of the blade being used to scrape the material.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
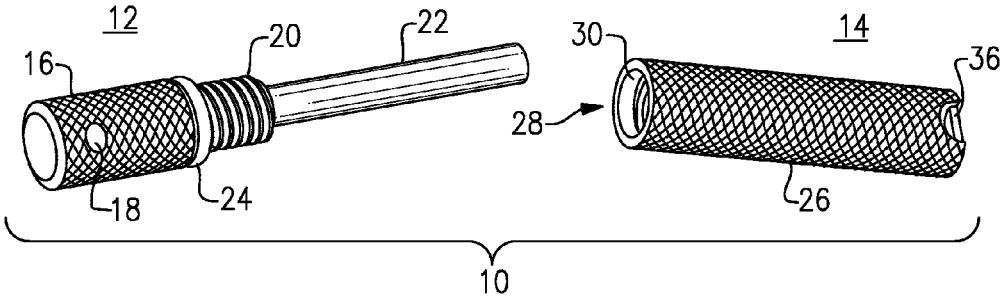
FIG. 1 is a perspective view showing the fire starter tool according to one preferred embodiment of this invention, showing the handle (with flint rod) and case portions.
Figure 2:
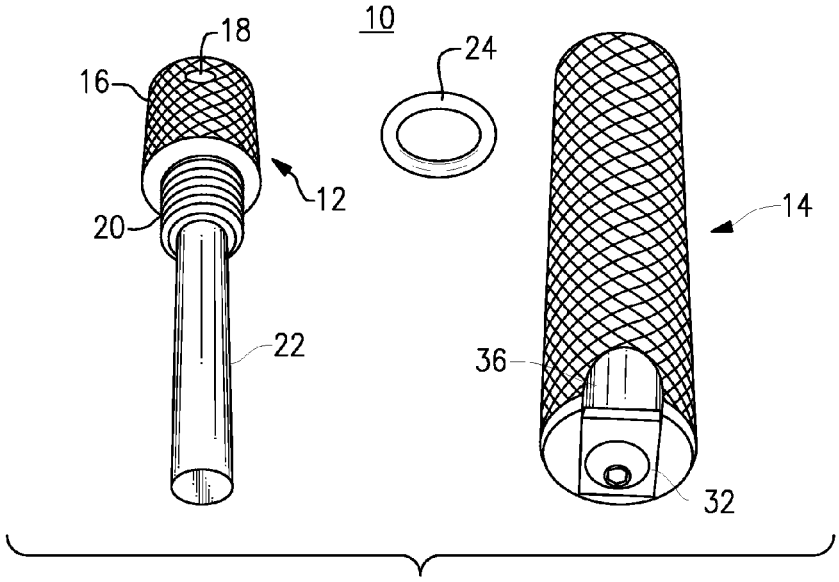
FIG. 2 is another perspective view thereof.
Figure 3:
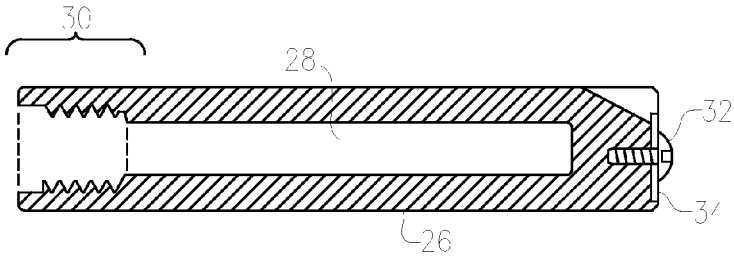
FIG. 3 is a cross sectional view of the case portion.

With reference now to the Drawing, and initially to FIGS. 1, 2 and 3, a fire starter survival tool 10 is shown as a handle portion 12 (on the left) and a case portion 14 (on the right). Here, the handle portion 12 has a handle or knob 16 that is formed as a knurled aluminum cylinder, with a through hole 18 at its proximal end for receiving a cord or lanyard (not shown), and a male threaded stem 20 at its distal end. A mischmetal flint rod 22 projects out (distally) from the stem 20. In this embodiment, a silicone rubber seal ring 24 is situated on the base of the stem 20, where it will form an environmental seal when the handle portion 12 and case portion 14 are closed together, and a plastic or other insulating sheath 18.

The case portion 14 is formed of a knurled aluminum cylindrical case 26, with an axial bore 28 extending from its proximal end, with a female threaded proximal portion 30 at the proximal end of the bore 28, and this portion 30 is threaded to receive the stem 20. The bore 28 is blind at its distal end and does not penetrate the distal end of the cylindrical case 26.

A steel strike plate 32 is affixed into a square recess 34 at the distal end of the case 26. Here, the plate 32 is secured with a screw that is threaded into a screw-hole at the distal end of the case. A partly cylindrical cutout 36 is formed on a diagonal at the distal end of the case 26, here at an angle of about 45 degrees, and this cutout serves as a guide channel for the mischmetal flint rod 22. The cutout 36 leads to a strike edge of the steel strike plate 32.

Figure 4:
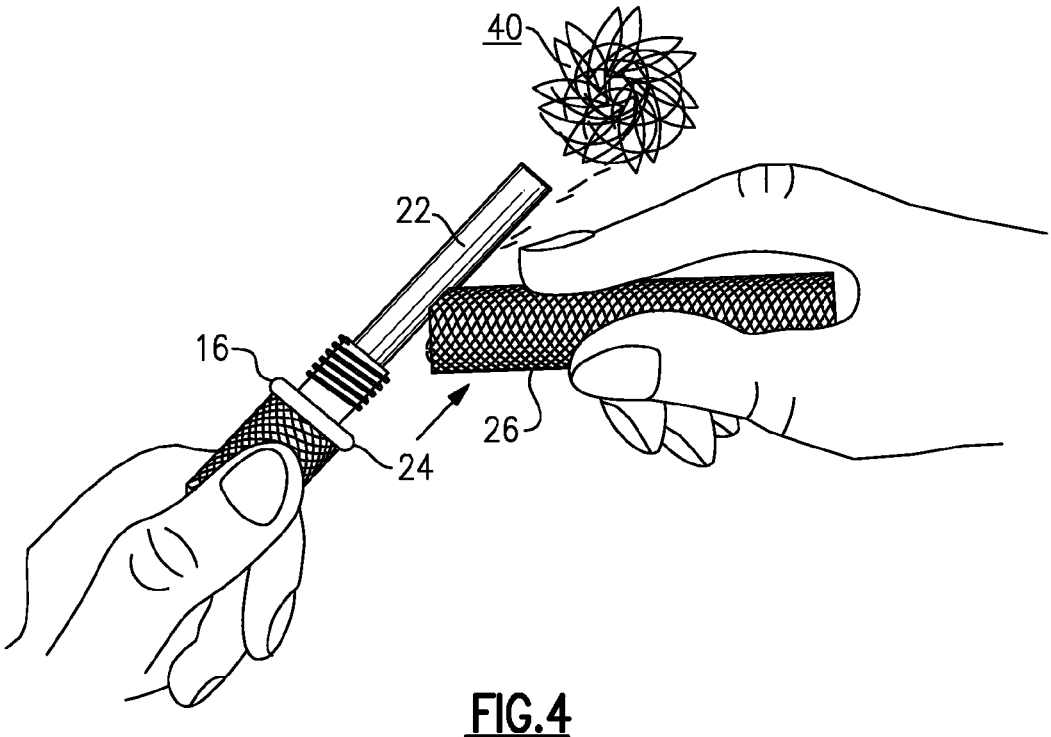
FIG. 4 illustrates the manner of use thereof.

The manner of use of this device 10 is illustrated in FIG. 4.

To strike a flame, the device 10 is twisted so that the handle portion 12 can be removed from the case portion 14, withdrawing the flint rod 22. An amount of tinder material 40 is placed at a desired location. The tinder material may be a convenient fibrous material, e.g., cotton, dryer lint, dried vegetative material, or fine wood fibers. The user holds the knob or handle 16 in one hand, and the case 26 in the other, held so that the guide cutout 36 positions the strike plate 32 properly in respect to the flint rod 22. The device is positioned as shown, aimed towards the tinder material 40, so that when the user moves the case portion in the direction of the arrow, a shower of sparks will fall on the tinder material and ignite it. The action of the steel strike plate 32 against the mischmetal material of the rod 22 causes flakes of magnesium and cerium (plus other rare earth elements) to fly off, and ignite. These flakes form hot particles that remain ignited long enough to start the tinder material. This usually occurs on the first strike, as the rod 22 gives up an ample shower of ignited magnesium particles.

When the user has started the tinder material on fire, it is a simple matter to insert the rod 22 into the bore 28 of the case 26, and then twist the handle portion 12 and case portion 14 together to close up the device. The seal ring 24 compresses between the distal surface of the handle 16 and the proximal surface of the case 26, so that the mischmetal flint rod 22 is environmentally sealed inside the bore 28, and is protected from moisture and other environmental elements.

The composition of the mischmetal flint rod, with a higher proportion of comparatively soft magnesium and lower proportion of iron, ensures that the strike plate 26 wears out only very slowly, and is condition for service when needed in emergency or survival conditions. Also, the flint rod 22 can be replaced in the handle 16 if it wears too thin, or if it breaks off.

While the invention has been described with reference to a specific preferred embodiment, the invention is certainly not limited to that precise embodiment. Rather, many modifications and variations will become apparent to persons of skill in the art without departure from the scope and spirit of this invention, as defined in the appended claims.

I claim:

1. A flint-based fire-starter survival tool, comprising a handle portion which includes a handle base having a gripping surface;

a male threaded portion extending distally from the handle base; and a mischmetal flint rod extending distally from said male threaded portion, wherein said rod is formed of a mischmetal material having a high standard reduction potential and a composition, by weight, as follows:

Cerium—one half

Lanthanum—26%

Magnesium—at least ten percent

Other rare earth elements—up to five percent

Iron—balance;

and a case portion that detachably mates with said handle portion to sheath said flint rod, and which includes a case base having an axial cavity adapted to accept said mischmetal flint rod and a female threaded portion at a proximal end of said axial cavity to mate with said male threaded portion;

a steel strike plate affixed to a distal surface of said case base; and a guide channel formed in said case base leading to said strike plate for guiding said flint rod to contact said strike plate.

2. The flint-based fire-starter survival tool of claim 1 further comprising a seal ring on one of said handle portion and said case portion and adapted for forming a water-tight seal between them and around said flint rod when said male threaded portion is screwed into said female threaded portion.

3. The flint-based fire-starter survival tool of claim 1 wherein mischmetal material is composed of the following, by weight:

cerium—50%; lanthanum—26%; magnesium—10%; praseodymium—3%; neodymium—1%; iron—10%.

4. The flint-based fire-starter survival tool of claim 1 wherein said handle base and said case base are formed of a cylindrical shape, with knurled cylindrical surfaces.

5. The flint-based fire-starter survival tool of claim 1 wherein said guide channel is a partly cylindrical cutout that extends diagonally into a distal end of said case base.

* * * * *